US008128138B2

(12) United States Patent
Bambenek et al.

(10) Patent No.: US 8,128,138 B2
(45) Date of Patent: Mar. 6, 2012

(54) ANTI-CHUCKING STRIKER

(75) Inventors: Charles G. Bambenek, Farmington, MI (US); Kosta Papanikolaou, Huntington Woods, MI (US); Venkatesh Krishnan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 734 days.

(21) Appl. No.: 12/127,281

(22) Filed: May 27, 2008

(65) Prior Publication Data

US 2009/0295196 A1 Dec. 3, 2009

(51) Int. Cl.
*E05B 15/02* (2006.01)

(52) U.S. Cl. ..... 292/340; 292/341

(58) Field of Classification Search ..... 292/340, 292/341

See application file for complete search history.

(56) References Cited

U.S. PATENT DOCUMENTS

| | | | | | |
|---|---|---|---|---|---|
| 4,883,298 | A * | 11/1989 | Kleefeldt | 292/341.12 |
| 4,981,313 | A * | 1/1991 | Makamura | 292/340 |
| 5,348,357 | A | 9/1994 | Konchan et al. | |
| 5,927,774 | A * | 7/1999 | Granger | 292/340 |
| 6,024,389 | A | 2/2000 | Arabia, Jr. et al. | |
| 6,042,160 | A * | 3/2000 | Hamada et al. | 292/216 |
| 6,073,980 | A | 6/2000 | Arabia, Jr. et al. | |
| 6,155,618 | A * | 12/2000 | Ichinose | 292/340 |
| 6,672,634 | B2 | 1/2004 | Burton | |
| 6,883,842 | B2 | 4/2005 | Paskonis | |
| 7,014,258 | B2 | 3/2006 | Schubring et al. | |
| 7,121,616 | B2 | 10/2006 | Cooley | |
| 7,188,872 | B2 | 3/2007 | Kalargeros et al. | |
| 7,308,731 | B2 | 12/2007 | Schubring et al. | |
| 7,631,909 | B2 * | 12/2009 | Snyder et al. | 292/340 |
| 7,828,348 | B2 * | 11/2010 | Bolbocianu et al. | 292/340 |
| 2006/0097550 | A1 | 5/2006 | Wang et al. | |
| 2006/0200939 | A1 | 9/2006 | Schubring et al. | |
| 2007/0001468 | A1 * | 1/2007 | Burton | 292/340 |
| 2007/0114802 | A1 * | 5/2007 | Johnson et al. | 292/340 |
| 2007/0241570 | A1 | 10/2007 | Paskonis | |
| 2009/0212579 | A1 * | 8/2009 | Hemingway et al. | 292/341.12 |
| 2010/0283271 | A1 * | 11/2010 | Hemingway et al. | 292/341.15 |
| 2011/0025078 | A1 * | 2/2011 | Gentile et al. | 292/341.12 |
| 2011/0025079 | A1 * | 2/2011 | Paskonis | 292/341.15 |

* cited by examiner

*Primary Examiner* — Thomas A Beach
*Assistant Examiner* — Mark Williams
(74) *Attorney, Agent, or Firm* — Gregory P. Brown; Price Heneveld LLP

(57) ABSTRACT

A vehicle including an anti-chucking striker overmold for minimizing chucking of a vehicle door having a latch therein. The anti-chucking striker overmold may include a striker mount connected to a striker and including one or more wedges including a first portion contiguously engageable with a latch frameplate opening to minimize movement of the vehicle door relative to the striker in a first direction. The wedge may include a second portion formed line-to-line with a fishmouth opening of the latch to minimize movement of the vehicle door in a second direction.

7 Claims, 6 Drawing Sheets

ANTI-CHUCKING STRIKER

BACKGROUND OF INVENTION a. Field of Invention

The invention relates generally to vehicle door latches and related components, and, more particularly, to an anti-chucking striker for providing resistance to chucking in a plurality of directions.

b. Description of Related Art

As is known in the art, vehicle side doors are susceptible to movement when the vehicle is riding over rough surfaces. This movement can result in noise, referred to as chucking, from the latch area. As readily evident to those skilled in the art, this noise would be objectionable from a design and customer satisfaction viewpoint.

Previous solutions have tried to utilize the striker itself to provide resistance to chucking in the vertical direction while a rubber wedge can provide resistance to chucking in the horizontal direction. For example, U.S. Pat. No. 6,024,389 to Arabia, Jr. discloses a vehicle door latch with stiffness adjustment. As shown in FIG. 2, Arabia, Jr. discloses a door latch with an overslam bumper including an elastomeric portion for engaging the striker, located at the rearward end. Elastomeric bumper 25 is L-shaped and fits into slot 27, with bumper 25 nearly extending the width of fishmouth slot 74 with one end near back plate 16 and the other near fork bolt 30. Bumper 25 is preloaded by a stiffness adjustment mechanism which includes an expandable bushing 22, a nut 23 and an adjustment screw 122.

While bumper 25 of Arabia, Jr. biases the striker in a predetermined position, it is nevertheless complex in design and operation based on its operation in conjunction with expandable bushing 22, nut 23 and adjustment screw 122. Moreover, bumper 25 also serves the limited purpose of biasing the striker, and no other apparent operational benefits.

Yet further, U.S. Pat. No. 7,188,872 to Kalargeros as illustrated in FIG. 1 thereof, discloses a latch mechanism including latch bolt 12 with overmold 18 composed of elastomeric material, defining first, second and third buffers, 20, 22, and 24 respectively. Third buffer 24 hits impact surface 38 of pawl 13 and displaces it. The noise of the impact between third buffer 24 and surface 38 is reduced due to elastomeric overmold 18.

Thus whereas Kalargeros discloses an overmold 18 for reducing impact noise, it does not address chucking related movement or noise from the latch area.

Accordingly, there remains a need for an anti-chucking device for providing resistance to chucking in a plurality of direction. There also remains a need for an anti-chucking device which is usable with existing latch/striker designs, and which is economical to manufacture, install and service.

SUMMARY OF INVENTION

The invention solves the problems and overcomes the drawbacks and deficiencies of prior art anti-chucking devices by providing a vehicle including an anti-chucking striker overmold for minimizing chucking of a vehicle door having a latch therein. The anti-chucking striker overmold may include a striker mount connected to a striker and including at least one wedge including a first portion contiguously engageable with a latch frameplate opening to minimize movement of the vehicle door relative to the striker in a first direction.

For the anti-chucking striker overmold described above, the wedge may include upper and lower wedges contiguously engageable with respective upper and lower portions of the latch frameplate opening. The first direction may be generally a vertical direction along a vehicle door pillar. A shield may be mounted to or formed with the striker mount, with the shield being sized to substantially cover a fishmouth opening of the latch to prevent air and dust intrusion into the latch when a catch of the latch is engaged with the striker. The wedge may include a second portion formed line-to-line with the fishmouth opening of the latch to minimize movement of the vehicle door in a second direction. The second portion may extend from the first portion, and the second direction may be generally orthogonal to the first direction. The wedge may be dimensioned to avoid interference with operation of a catch of the latch. The anti-chucking striker overmold may be insert molded onto the striker.

The invention also provides an anti-chucking striker overmold for minimizing chucking of a vehicle door having a latch therein. The anti-chucking striker overmold may include a striker mount connectable to a striker and including at least one wedge including a first portion contiguously engageable with a latch frameplate opening to minimize movement of the vehicle door relative to the striker in a first direction.

For the anti-chucking striker overmold described above, the wedge may include upper and lower wedges contiguously engageable with respective upper and lower portions of the latch frameplate opening. The first direction may be generally a vertical direction along a vehicle door pillar. A shield may be mounted to or formed with the striker mount, with the shield being sized to substantially cover a fishmouth opening of the latch to prevent air and dust intrusion into the latch when a catch of the latch is engaged with the striker. The wedge may include a second portion formed line-to-line with the fishmouth opening of the latch to minimize movement of the vehicle door in a second direction. The second portion may extend from the first portion, and the second direction may be generally orthogonal to the first direction. The wedge may be dimensioned to avoid interference with operation of a catch of the latch. The anti-chucking striker overmold may be insert molded onto the striker.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
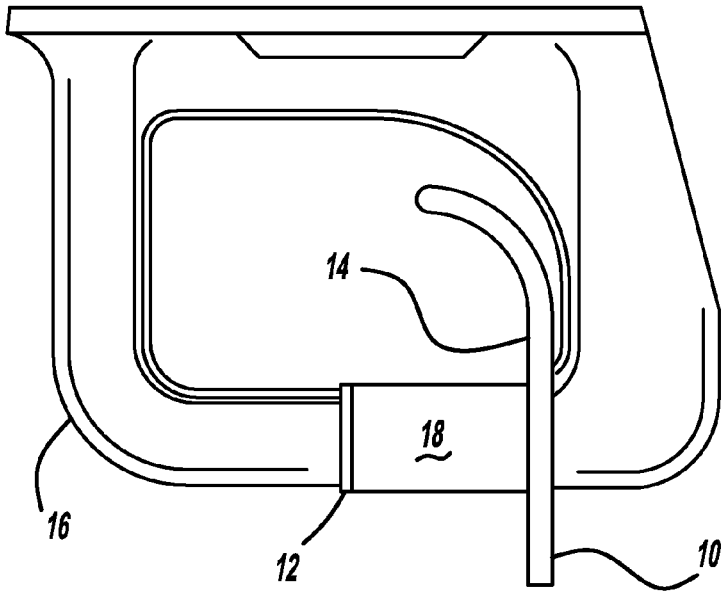
FIG. 1 is a side view of an anti-chucking striker overmold according to the present invention, with the striker overmold being mounted on a striker.

Referring now to the drawings wherein like reference numerals designate corresponding parts throughout the several views, FIGS. 1-7 illustrate an anti-chucking striker overmold according to the present invention, generally designated "anti-chucking striker overmold 10."

Figure 2:
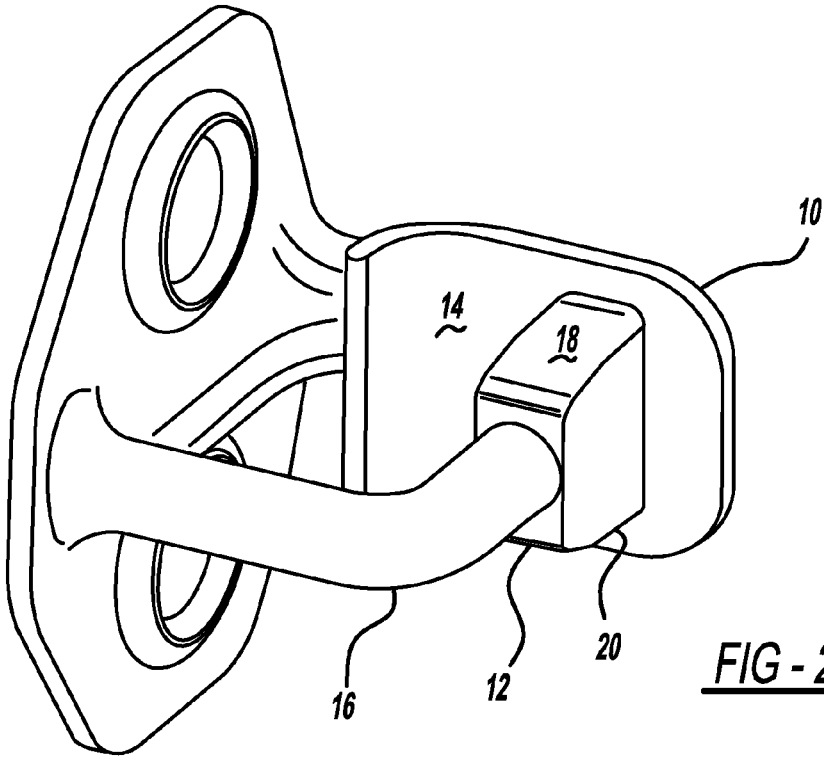
FIG. 2 is an isometric view of the anti-chucking striker overmold of FIG. 1, with the striker overmold being mounted on a striker.
Figure 3:
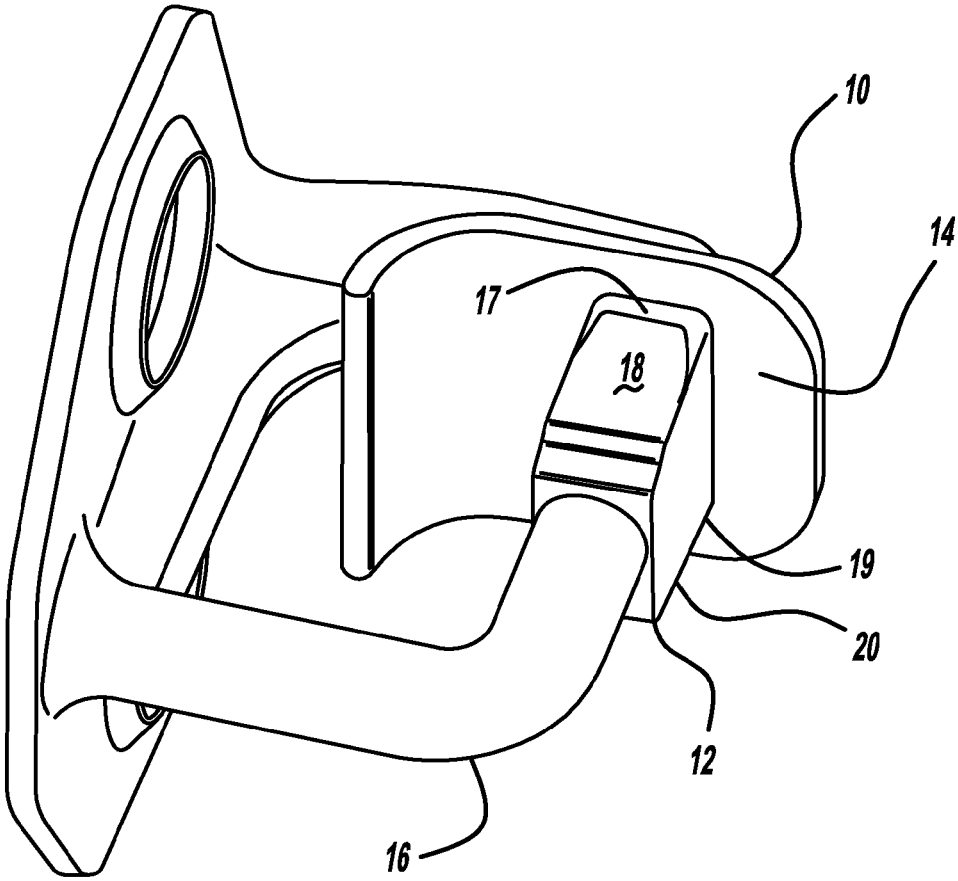
FIG. 3 is another isometric view of the anti-chucking striker overmold of FIG. 1, with the striker overmold being mounted on a striker.

Specifically, referring to FIGS. 1-3, anti-chucking striker overmold 10 may generally include a striker mount 12 and shield 14. In the exemplary embodiment illustrated, anti-chucking striker overmold 10 may be insert molded onto striker 16, or mounted to striker 16 in another manner as apparent to those skilled in the art in view of this disclosure. Striker mount 12 may include upper and lower wedges 18, 20, the purpose for which will be described below. Further, shield 14 may be curved as illustrated in FIG. 1, the purpose for which will be likewise described below.

Figure 4:
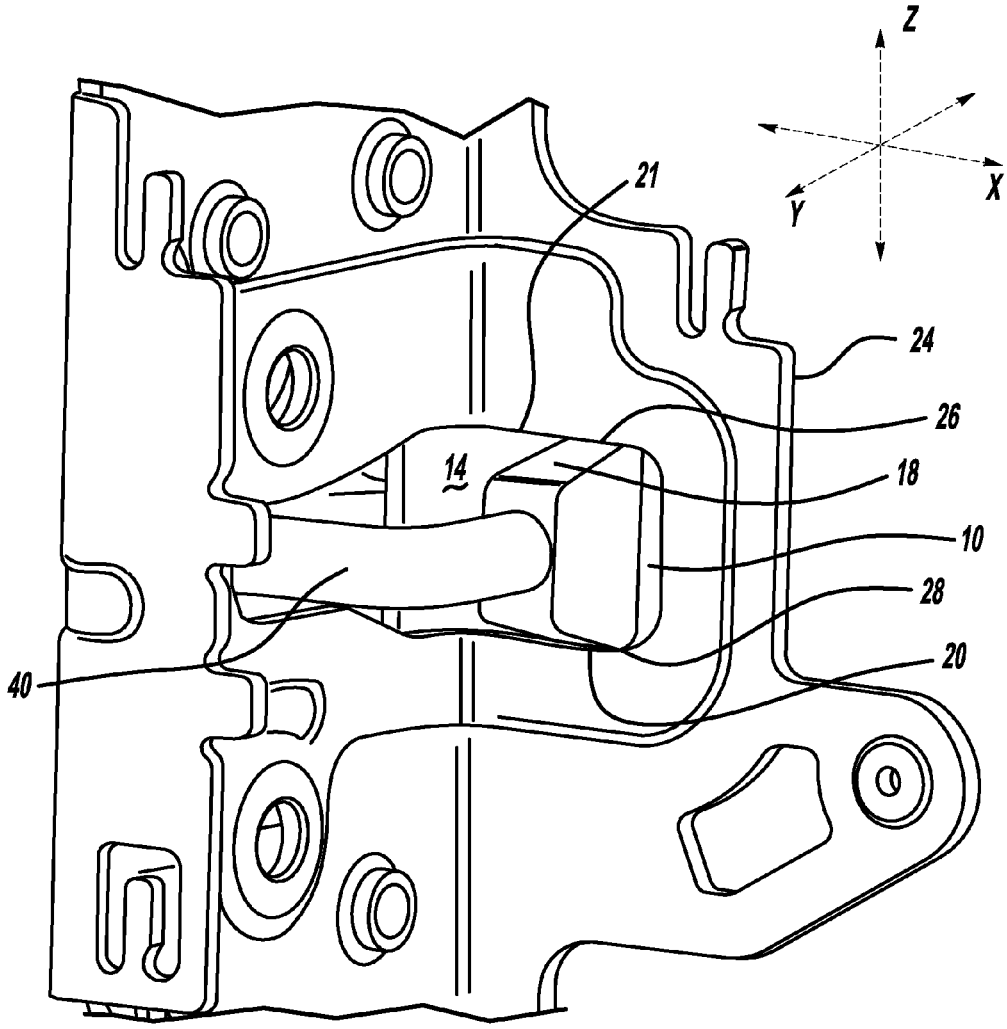
FIG. 4 is an isometric view of the anti-chucking striker overmold of FIG. 1 mounted on a striker, and shown in relation to a latch frameplate.

Referring to FIG. 4, anti-chucking striker overmold 10 is illustrated as mounted on striker 16 which is installed on a door pillar (not shown) in a known manner. As illustrated, relatively flat sections 17, 19 of upper and lower wedges 18, 20 may contact opening 21 of latch frameplate 24 at locations 26, 28 to transmit z-axis loads (in the FIG. 4 orientation) to the frameplate and to thus resist vertical motion of the associated latch (not shown) and door (not shown).

Figure 5:
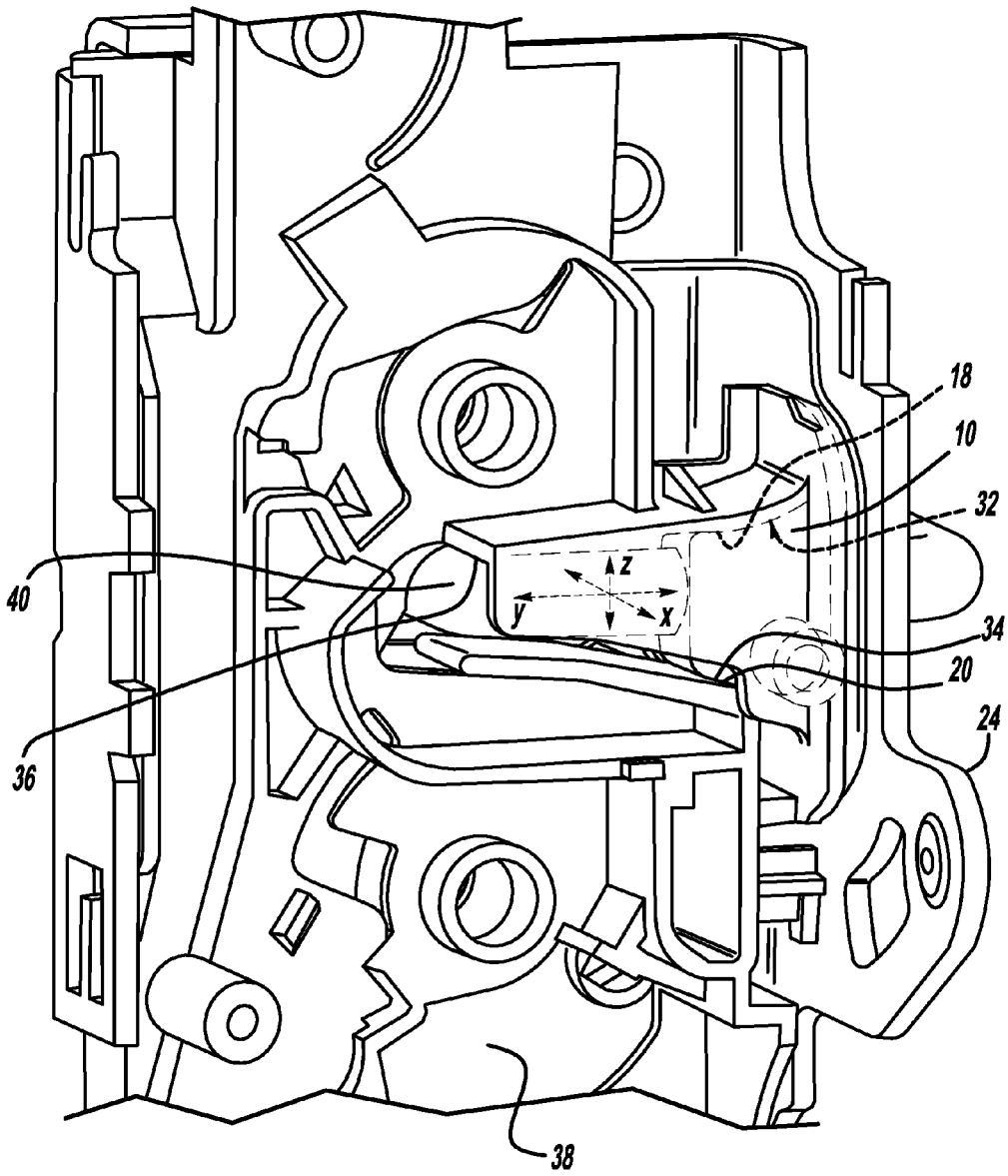
FIG. 5 is an isometric view of the anti-chucking striker overmold of FIG. 1 mounted on a striker, and shown in relation to a latch housing and frameplate.

Referring to FIG. 5, wedges 18, 20 may further include generally concave extensions 32, 34 which, in the embodiment illustrated, may be designed line-to-line with fishmouth 36 of the latch for transmitting y-axis loads (in the FIG. 5 orientation) to housing 38 for thus restricting cross-car motion. Thus extensions 32, 34 of wedges 18, 20 essentially wedge into fishmouth opening 36 as shown in FIG. 5.

Figure 6:
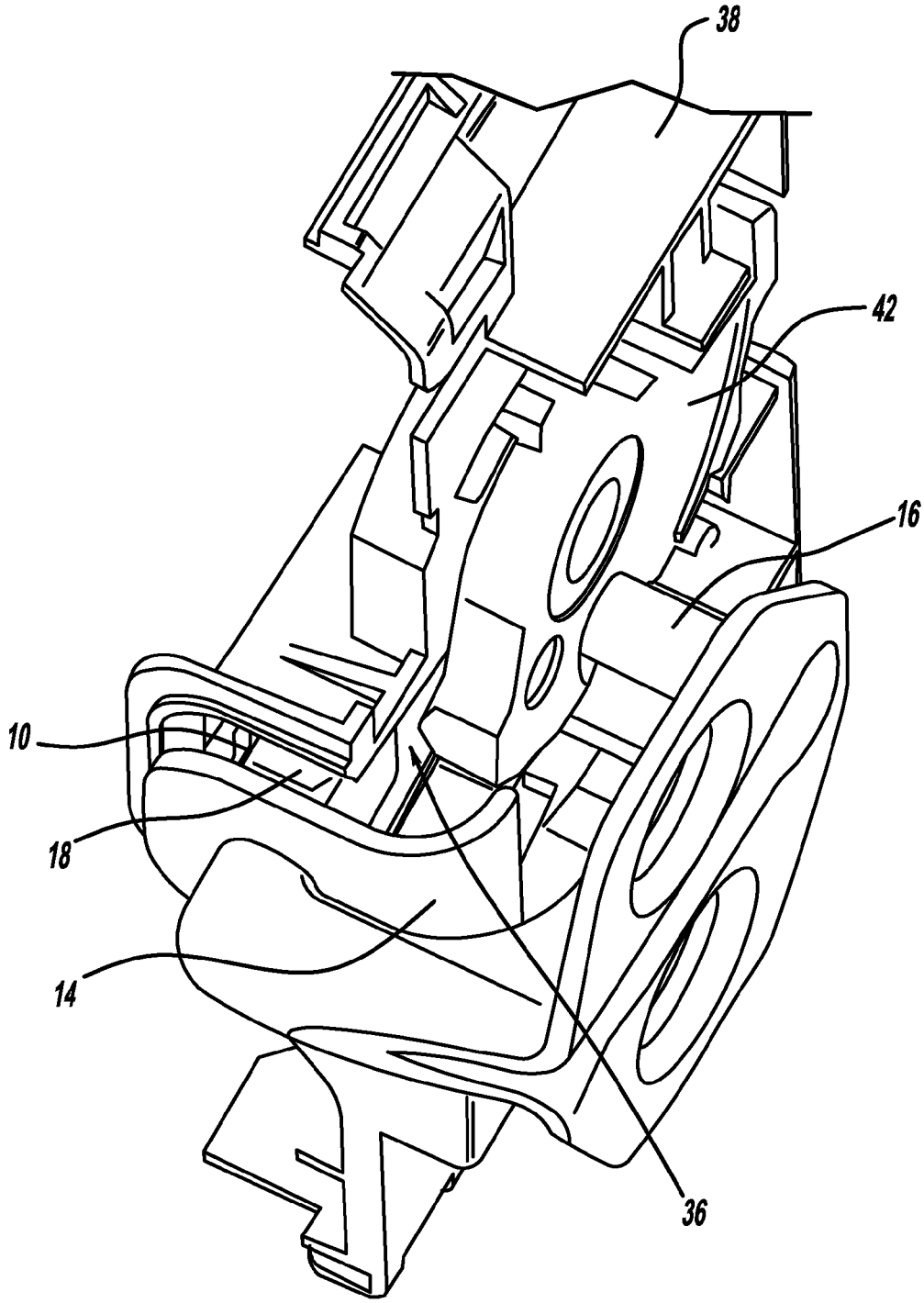
FIG. 6 is an isometric view of the anti-chucking striker overmold of FIG. 1 mounted on a striker, and shown in relation to a latch housing and catch.

Referring next to FIG. 6, in an exemplary embodiment, anti-chucking striker overmold 10 may have a slightly smaller width than striker post 40 (see FIG. 4) for maintaining clearance to catch 42 for allowing adequate operation of the latch/striker assembly.

Figure 7:
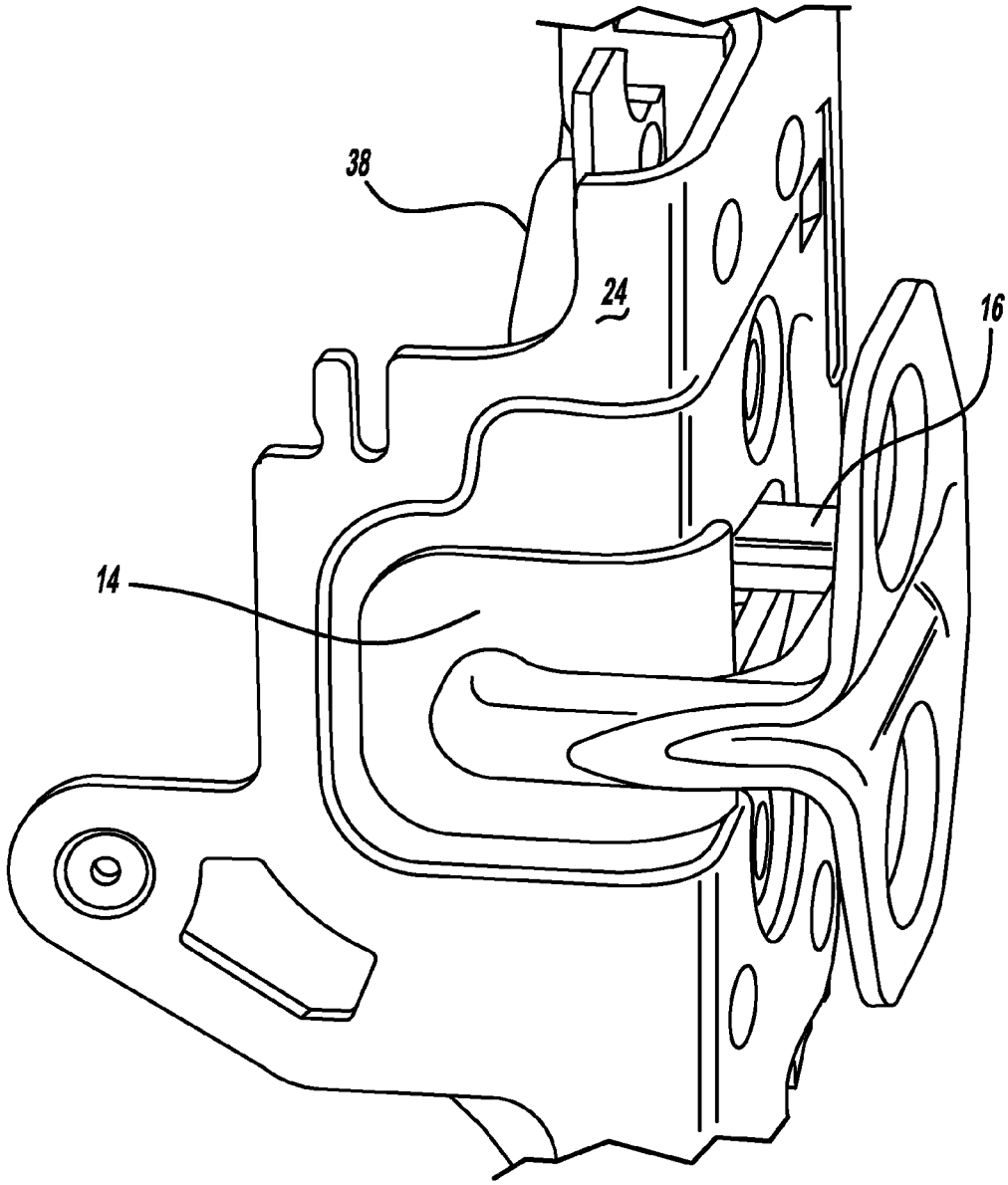
FIG. 7 is an isometric view of the anti-chucking striker overmold of FIG. 1 mounted on a striker, shown in relation to a latch frameplate and illustrating the sealing action of the anti-chucking striker overmold.

Referring to FIGS. 6 and 7, in a vehicle door closed position when catch 42 is engaged with striker 16, shield 14 may seal a significant portion of the area of fishmouth 36 to reduce air leakage and dust intrusion into the latch or adjacent components.

The operation of anti-chucking striker overmold 10 will now be described in detail with reference to FIGS. 1-7.

Specifically, as shown in FIG. 1-4, with anti-chucking striker overmold 10 mounted on striker 16, when the door (not shown) including a latch (not shown) is closed to engage catch 42 with striker 16, relatively flat sections 17, 19 of upper and lower wedges 18, 20 may contact opening 21 of latch frameplate 24 at locations 26, 28 to transmit z-axis loads (in the FIG. 4 orientation) to the frameplate and to thus resist vertical motion of the latch and associated door (not shown). At the same time, as shown in FIG. 5, concave extensions 32, 34 of wedges 18, 20 may contact fishmouth 36 of the latch for transmitting y-axis loads (in the FIG. 5 orientation) to housing 38 for thus restricting cross-car motion. Lastly, referring to FIG. 7, shield 14 may seal a significant portion of the area of fishmouth 36 to reduce air leakage and dust intrusion into the latch or adjacent components.

To summarize, anti-chucking striker overmold 10 thus provides an anti-chucking device which provides resistance to chucking in a plurality of direction (i.e. z-axis direction for FIG. 4 and y-axis direction for FIG. 5), and further provides additional operational benefits in reducing air and dust intrusion into the latch or adjacent component areas.

Those skilled in the art would readily appreciate in view of this disclosure that a variety of modifications may be made to anti-chucking striker overmold 10 without departing from the scope of the present invention. For example, concave extensions 32, 34 of wedges 18, which contact fishmouth 36 of the latch may be shaped as needed for contacting fishmouth 36. Further, instead of anti-chucking striker overmold 10 being insert molded onto striker 16, striker overmold 10 may be snap-fitted onto striker 16 or otherwise attached to striker 16 by an adhesive or other mechanical engagement.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A vehicle including an anti-chucking striker overmold for minimizing chucking of a vehicle door, the vehicle comprising;

a structure defining a door opening;

a door movably mounted to the structure, wherein the door includes a latch, a structure having spaced apart inwardly-facing surfaces defining a striker-receiving opening therebetween, and wherein the door includes an outwardly-facing peripheral surface extending around the striker-receiving opening, a striker mount;

a striker connected to the striker mount, wherein the striker includes a first portion extending in a first direction, and a second portion extending in a second direction that is substantially orthogonal to the first direction, the anti-chucking striker overmold comprising at least one elastomeric overmolded wedge disposed on the first portion of the striker, wherein material of the elastomeric overmolded wedge is different than material of the striker, and wherein the overmolded wedge includes an inner wedge portion disposed inside the striker-receiving opening, and an outer wedge portion disposed adjacent the striker-receiving opening, the overmolded wedge further including tapered opposite surfaces that extend between the inner and outer portions and simultaneously engage the spaced apart inwardly-facing surfaces of the latch-receiving opening and minimize movement of the vehicle door relative to the striker in the first direction and in the second direction;

wherein the overmolded wedge includes a shield comprising a flange that extends outwardly from the first portion of the striker, the flange having a side surface that faces in the first direction, wherein the side surface engages the peripheral surface of the door on opposite sides of the opening and reduces surface air and dust intrusion into the latch.

2. A vehicle according to claim 1, wherein the flange of the shield includes first and second portions extending in opposite directions away from the first portion of the striker, the flange further including a distal end portion extending transverse to the first portion.

3. A vehicle according to claim 2, wherein the overmolded wedge includes oppositely-facing generally planar outer surfaces extending between the tapered opposite surfaces whereby the overmolded wedge has a generally rectangular cross-sectional shape.

4. A vehicle according to claim 3, wherein the side surface of the flange includes generally planar flange surface portions extending away from the oppositely-facing planar outer surfaces.

5. A vehicle according to claim 4, wherein the planar flange surface portions are orthogonal to the oppositely-facing planar outer surfaces.

6. A vehicle according to claim 1, wherein the elastomeric overmolded wedge is insert molded onto the striker.

7. A vehicle according to claim 1, wherein the first portion of the striker comprises a cylindrical post.

* * * * *